United States Patent [19]

Grubb et al.

[11] Patent Number: 4,549,343

[45] Date of Patent: Oct. 29, 1985

[54] APPLICATOR FOR INSTALLING TWO PART CONNECTOR ASSEMBLIES IN CABLES

[75] Inventors: Daniel B. Grubb, Hummelstown; Donald W. K. Hughes, Mechanicsburg, both of Pa.

[73] Assignee: AMP Incorporated, Harrisburg, Pa.

[21] Appl. No.: 529,054

[22] Filed: Sep. 2, 1983

[51] Int. Cl.[4] ..... H01R 43/04

[52] U.S. Cl. ..... 29/33 M; 29/566.3

[58] Field of Search ..... 29/33 M, 566.3, 566.4, 29/566, 749, 566.1, 564.6, 564.7, 564.8, 564.2, 56.5, 56.6, 748

[56] References Cited

U.S. PATENT DOCUMENTS

| | | | |
|---|---|---|---|
| 3,758,935 | 9/1973 | Long et al. | 29/566.4 |
| 3,800,390 | 4/1974 | Johnston | 29/749 |
| 3,845,535 | 11/1974 | Over | 29/56.6 |
| 3,864,802 | 2/1975 | Tucci | 29/566.3 |
| 3,866,296 | 2/1975 | Tucci | 29/749 |
| 3,972,101 | 8/1976 | Casey et al. | 29/749 |
| 4,110,896 | 9/1978 | Roiko | 29/566.3 |
| 4,193,177 | 3/1980 | Fitzgerald | 29/566.3 |
| 4,282,644 | 8/1981 | Petree | 29/566.3 |
| 4,317,608 | 3/1982 | Dechelette | 339/99 R |
| 4,344,225 | 8/1982 | Johnson et al. | 29/33 M X |
| 4,441,251 | 4/1984 | Grubb | 29/749 X |

*Primary Examiner*—William R. Briggs

*Attorney, Agent, or Firm*—Frederick W. Raring

[57] ABSTRACT

Apparatus for installing connectors on cables is disclosed. Each connector comprises a connector housing having a conductor receiving end and terminals therein which receive wires and establish contact therewith. A cover or closure is provided which is assembled to the connector housing at the conductor receiving end. The apparatus comprises a housing jig, a cover jig which is opposed to the housing jig, and a cable locator which locates the cable between the two jigs. Cooperating cutter blades may be provided on the jigs so that when they are moved towards each other, the cable will be cut and the conductors moved into the terminals in the connector housing. In accordance with a further embodiment, the housings and covers are produced as continuous strip material which is fed to the two jigs. Strip material cutters are provided for cutting a connector housing and a section of cover members from the strip at the time of installation of the connector on the cable.

8 Claims, 18 Drawing Figures

70
72
84
82
80
78
76
62
28
64
60
66
68
26
32
34
30
30'
16
8
20
30
58
18
24'
13
20
14'
12
14'
13
14

APPLICATOR FOR INSTALLING TWO PART CONNECTOR ASSEMBLIES IN CABLES

FIELD OF THE INVENTION

This invention relates to apparatus for installing connectors on cables, the connectors being of the type comprising a housing and a cover member or closure which is assembled to the conductor receiving face of the housing when the conductors are connected to terminals in the housing. The invention is particularly directed to the achievement of improved apparatus having cutters for cutting the cable or wires during installation of the connector and further to the achievement of an apparatus which can be used with connector housing material and cover material in continuous strip form.

BACKGROUND OF THE INVENTION

Application Ser. No. 526,945, filed Aug. 29, 1983 discloses and claims multi-contact electrical connectors of the type having a connector housing, terminals in the housing, and a cover member which is assembled to the conductor receiving face of the housing after wires are connected to the terminals in the housing. Housings as described in the above identified application may be either of the wire end type which are installed on the ends of wires or of the feed-through type which are so called for the reason that the wires extend through the connector and the connector is installed at an intermediate location on the cable or wires. The present invention is generally directed to the achievement of an improved apparatus for installing connectors as disclosed, for example, in application Ser. No. 526,945 on wires or cables. The invention is also directed to the achievement of an apparatus having a wire or cable cutter which function to trim the cable or wire at the time of installation of the connector on the cable. In accordance with a further aspect, the invention is directed to the achievement of an apparatus which can be used with continuous strips of connector housing material and connector cover material so that connectors of any desired size can be produced by simply trimming a connector housing and cover from the end portions of the continuous strips when the connector is installed on the cable.

One embodiment of the invention comprises an apparatus for cutting a cable and installing a connector assembly on the cut end of the cable, the cable comprising a plurality of conductors in side-by-side parallel relationship in a single plane. The connector assembly comprises a connector housing and a cover, the housing having a conductor-receiving face, oppositely facing housing sidewalls and oppositely facing housing endwalls, the sidewalls and endwalls surrounding, and extending from, the conductor-receiving face. The housing has a row of spaced-apart terminals therein which extend between the endwalls, the terminals having conductor-receiving slots at the conductor receiving face. The slots extend normally of the conductor-receiving face so that conductors which extend parallel to the conductor-receiving face can be moved laterally of their axes and into the conductor-receiving slots. The cover is dimensioned for assembly to the conductor-receiving face and has inserters thereon for moving conductors into the conductor-receiving slots upon assembly to the housing. The cover has oppositely facing side surfaces and oppositely facing end surfaces which are contiguous with the housing sidewalls and housing endwalls respectively when the cover is assembled to the housing. The apparatus is characterized in that it comprises a cover jig, a housing jig, and a cable locator, the housing jig being opposed to the cover jig. The housing jig and the cover jig have housing holding means and cover holding means respectively for holding a housing with the conductor receiving face thereof opposed to a cover in the cover jig. The jigs are relatively movable towards each other to assemble the cover to the mating face of the housing. The cable locator is between the cover jig and the housing jig and is effective to locate a cable in a plane between the jigs with the conductors in the cable in alignment with the conductor-receiving slots in terminals in a housing in the housing jig. The housing jig has a first shearing edge thereon which extends parallel to, and is beside one sidewall of a housing in the housing jig. The cover has a second shearing edge thereon which extends beside, and is adjacent to, the one side surface of a cover in the cover jig which is in alignment with the one sidewall of the housing in the housing jig whereby, upon placement of a connector housing and cover in the housing jig and cover jig, location of a cable by the cable locator, and upon relative movement of the cover jig towards the housing jig, the cable will be severed by the shearing edges and the conductors will be inserted into the conductor-receiving slots of the terminals. If the apparatus is specifically intended for installing a connector on a cable comprising a plurality of discrete wires, the cable locator has a plurality of spaced-apart notches each of which is designed to receive a discrete wire.

A further embodiment comprises an apparatus of the type comprising a wire jig, a housing jig, and a plurality of inserters, the wire jig having wire locators for locating the wires in parallel spaced-apart relationship in a single plane with the spacing between the wires equal to the spacing between the terminals in the housing. The housing jig is on one side of the single plane and is positioned to hold a housing with the wire-receiving slots in the terminals in alignment with the wires, the inserters are on the other side of the single plane, each of the inserters being in alignment with one of the wires. The inserters are movable relatively towards the plane so that the inserters push the wires towards a housing in the housing jig and into the wire-receiving slots of the terminals, the apparatus is characterized in that the inserters are integral with a connector closure which is dimensioned to be assembled to the housing during insertion of the wires into the wire-receiving slots, the closure having one major surface from which the inserters extend and having oppositely facing side surfaces and oppositely facing end surfaces which surround, and extend from the one major surface. A connector closure jig is provided on the other side of the single plane, the closure jig being movable relatively towards and away from the housing jig. The housing jig has a first shearing edge thereon and the closure jig has a second shearing edge thereon, the first shearing edge extending parallel to, and being beside, one sidewall of a housing in the housing jig and the second shearing edge being opposed to, and cooperable with the first shearing edge whereby during assembly of the housing to the closure, the wires are severed by the shearing edges.

A further embodiment is characterized in that a housing severing blade is provided in the closure jig, the housing severing blade having a housing severing edge which extends normally of the second shearing edge and is located between two adjacent wires in the wire jig whereby the housing and closure are severed between two adjacent cavities. A further embodiment is characterized in that the first severing edge and the second severing edge each have a plurality of spaced-apart notches therein which are in opposed aligned relationship, the apparatus being intended for use with a housing having wire admitting slots in the one sidewall at the wire-receiving face which are in alignment with the terminals in the cavities. The housing and closure have ledges on the one sidewall and on the one side surface of the housing and closure respectively, the ledges being between juxtaposed cavities in the housing, the notches being dimensioned to receive the ledges.

In accordance with a further embodiment, the apparatus is intended for use with housing strip material and cover strip material, the housing strip material comprising a continuous strip of housing so that a connector can be produced by trimming the end portion of the strip. Similarly, the cover strip material is trimmed to produce a cover member for the housing. The apparatus has guides for guiding the housing strip material and cover strip material to the housing jig and the cover jig and cutters are provided for trimming the housing from the end of the housing strip and the cover from the end of the cover strip.

An understanding of a apparatus in accordance with the invention will be facilitated by an understanding of the type of connector for which the apparatus is intended and the type of electrical harness produced with the apparatus. Accordingly, a description of the connectors used with the apparatus and the harnesses produced will be presented prior to the description of the apparatus itself.

Figure 1:
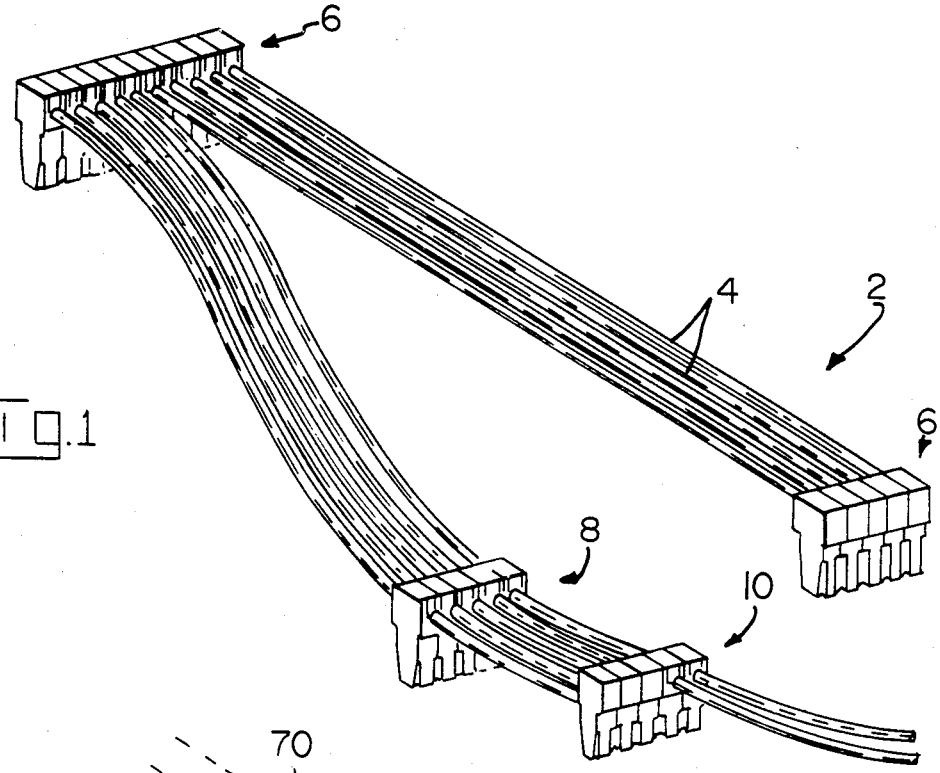
FIG. 1 is a perspective view of a harness of a type produced by an apparatus in accordance with the invention.
Figure 3:
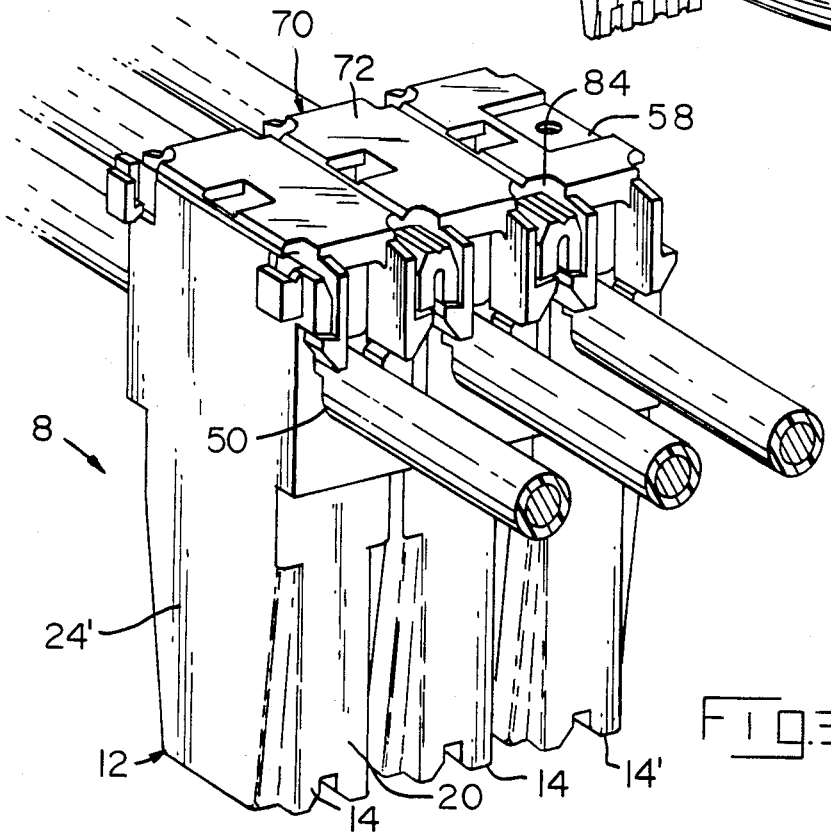
FIG. 3 is a perspective view showing a connector of the type shown in FIG. 2 installed on discreet wires.

FIG. 1 shows a harness 2 comprising a cable in the form of a plurality of discreet wires 4 and connectors 6, 8, 10. The connectors 6 are referred to as wire end connectors for the reason that they are installed on the ends of wires 4. The connector 8 is a feed-through type connector in that it is installed on the wires intermediate the ends and the wires pass through the connector and are connected to terminals in the connector 8. The connector 10 is a composite type having two wires extending therethrough and having the remaining wires ending at the terminals in the connector 10. All three types of connectors are described below.

Figure 2:
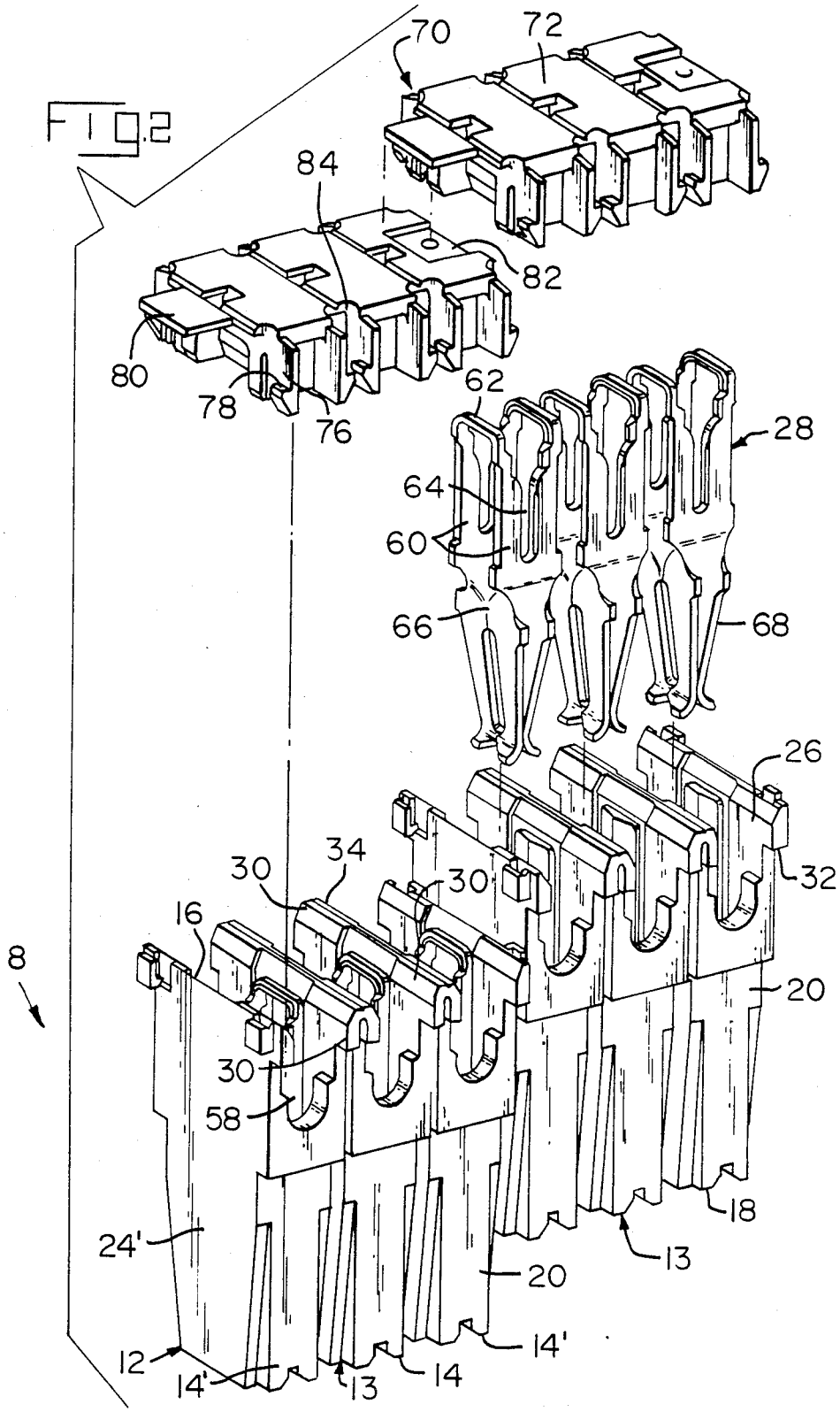
FIG. 2 is a perspective exploded view showing one type of connector, terminals exploded from some of the cavities of the connector, and closure or cover members in alignment with the mating face of the connector.
Figure 4:
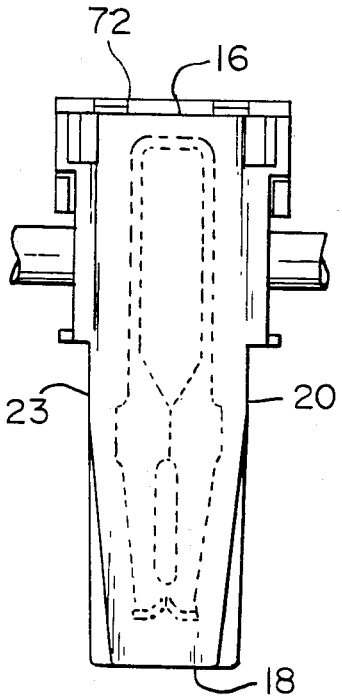
FIGS. 4 and 5 are an end view and side view respectively of an individual cell of a connector.
Figure 5:
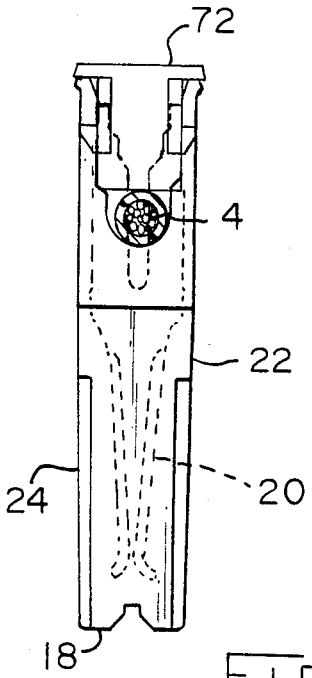

A connector as shown at 8 (FIGS. 2-7) comprises a housing 12 which is comprised in turn of one or more housing segments 13 which are latched together as described below. Each segment as shown in FIG. 2 has three housing cells, the center cell being identified at 14 and the cells at the ends of the segment being shown at 14'. In practice, it may be desirable to produce segments having a greater number of intermediate cells 14. The housing has a conductor receiving end 16, a mating end 18, oppositely facing sidewalls 20, 23, and oppositely facing endwalls 22, 24, and 22', 24'. The cell endwalls 22', 24' are at the ends of segments and differ from the intermediate cell endwalls 22, 24 in that latches are provided as described below.

Each cell has a terminal receiving cavity 26 extending therein from the conductor receiving face or end 16 and a terminal 28 is positioned in each cavity. Adjacent cells are connected to each other by integral cell webs 30 that extend beyond the cell sidewalls 20, 23 and which provide downwardly facing shoulders 32 between adjacent cells. The cell webs do not extend continuousing between the cell sidewalls but are provided only adjacent to the sidewalls and the webs are provided with kerfs 34 to facilitate cutting as will be described below.

Figure 6:
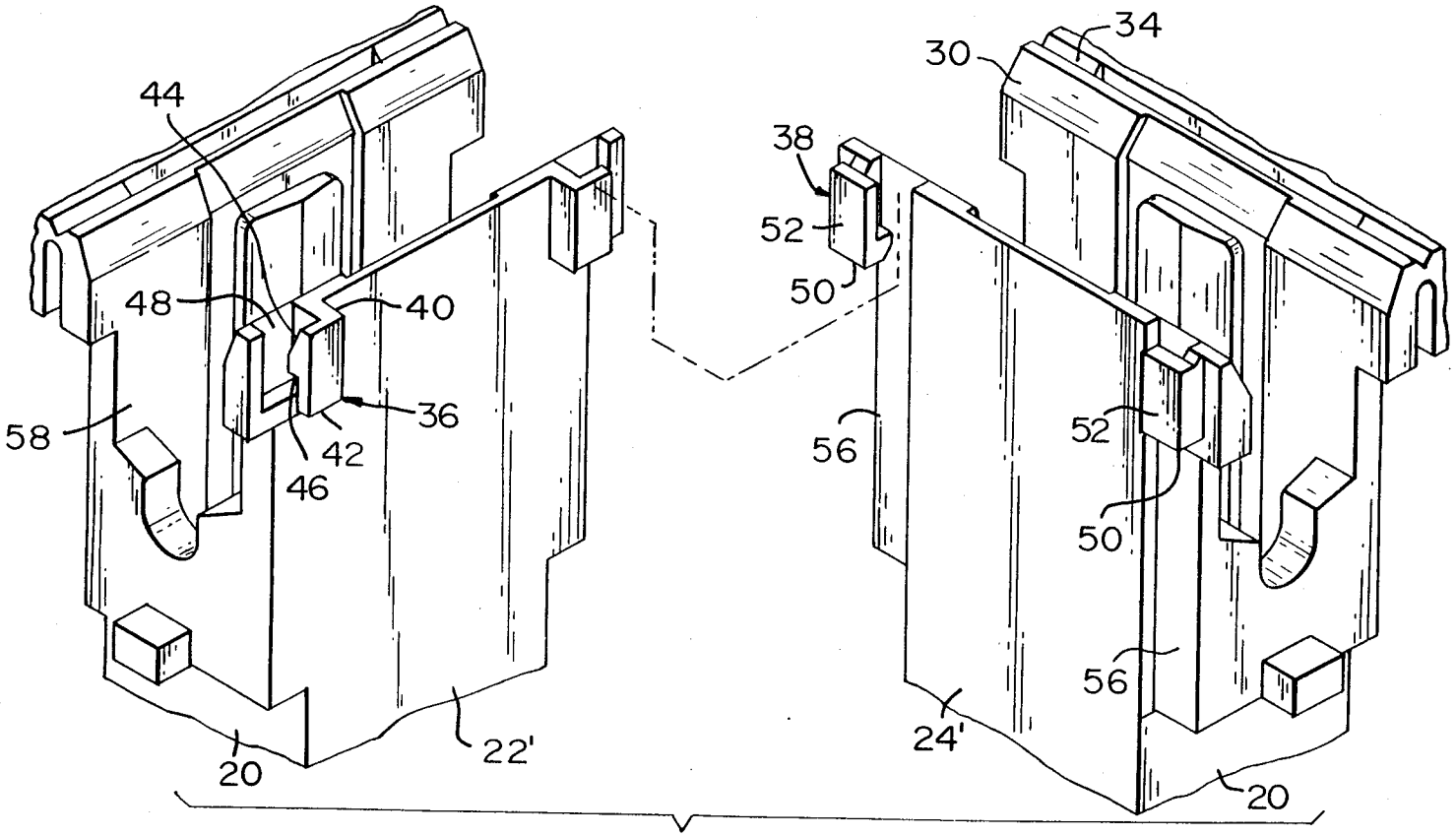
FIG. 6 is an enlarged perspective view showing the opposed endwalls of two connector segments, the segments being oriented at right angles to show details of a latching mechanism on the endwalls.
Figure 8:
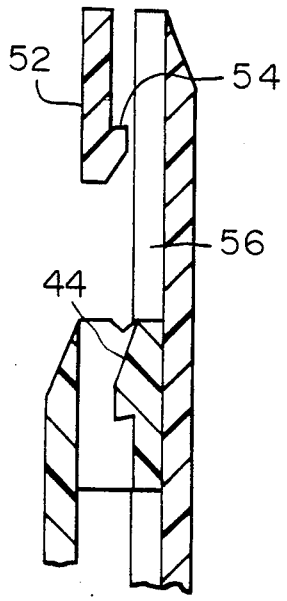
FIG. 8 is a view taken along the lines 8—8 of FIG. 7 showing the cross section of the latching members.
Figure 7:
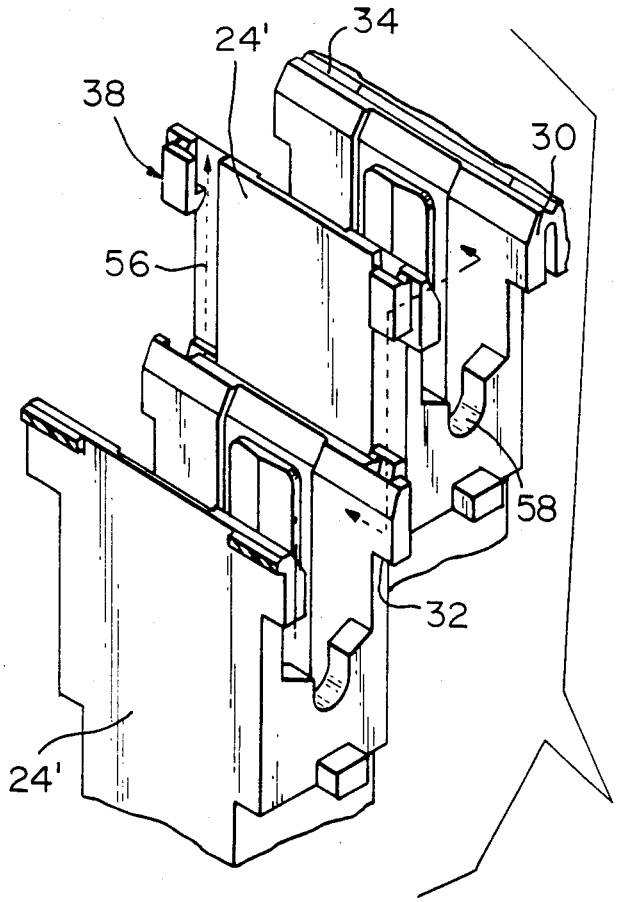
FIG. 7 is a view which shows the endwalls in alignment with each other in preparation for latching of the two segments to each other.
Figure 9:
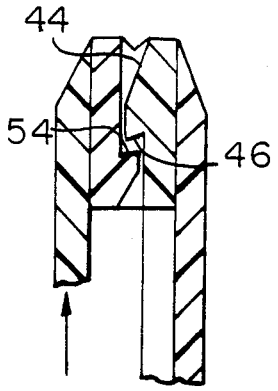
FIG. 9 is a view similar to FIG. 8 but showing the latches in the engaged positions.
Figure 11:
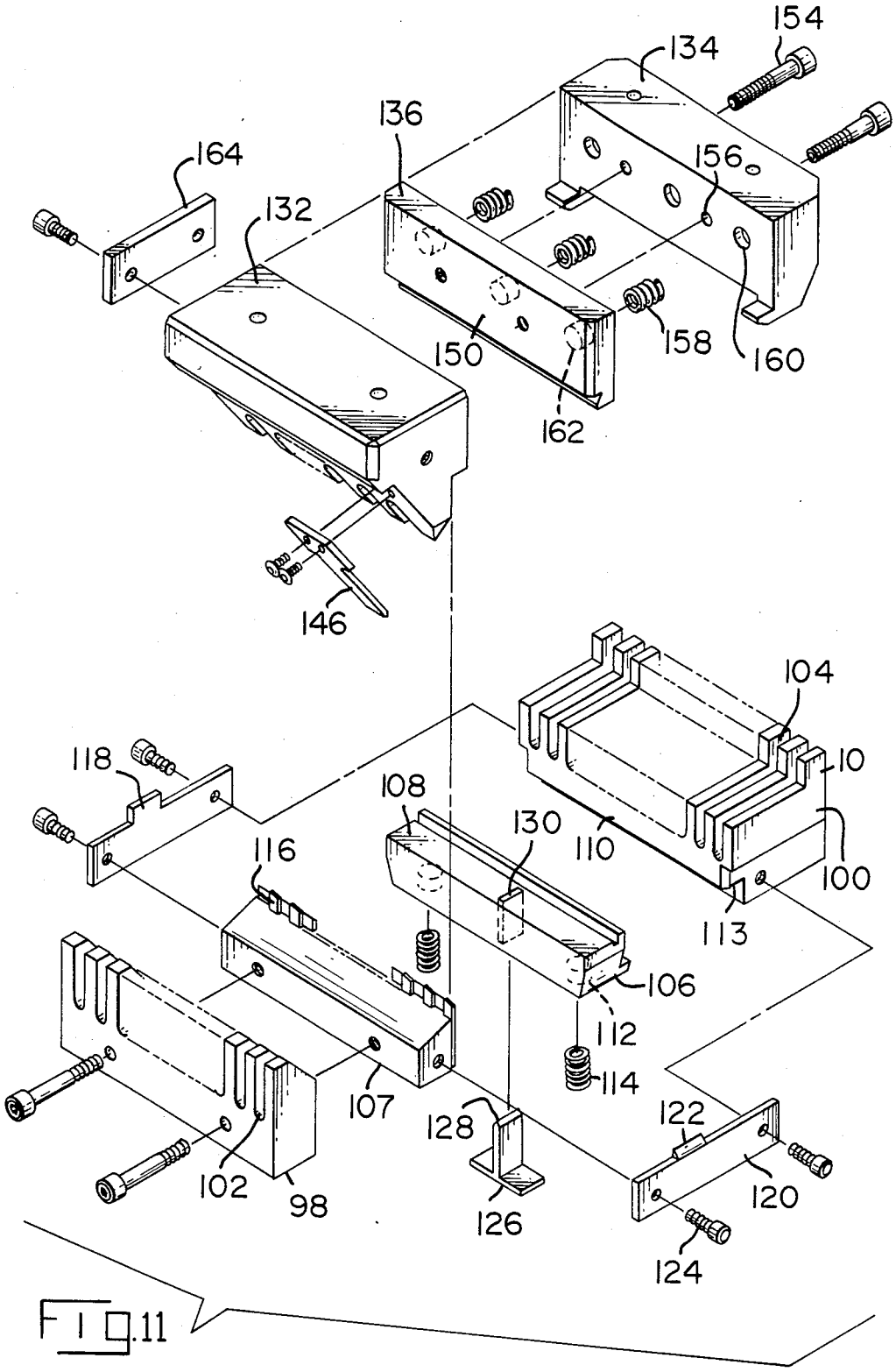
FIG. 11 is a perspective view showing the parts of an apparatus in accordance with the invention.

Referring to FIGS. 6 and 7, two segments 13 can be latched to each other by latches 36 and 38 on the endwalls 22', 24' respectively. The latches 36 on the endwall 22' each comprise an L-shaped extension 40 on the endwall adjacent to the conductor receiving face of the cell and the free arm 42 of the extension 40 has a ramp 44 on its inwardly facing surface, the surface which is directed towards a recess 48 in the endwall 22'. The ramp extends to a downwardly facing shoulder 46 which is cooperable with an upwardly facing shoulder 54 on a latch 38 on the endwall 24'. The latch 38 also comprises an L-shaped extension 50 having a free arm 52 at the lower end of which is provided the upwardly facing shoulder 54, see FIGS. 8 and 9. Endwall 24' has recesses 56 in alignment with the latches 38 and these recesses receive the latches 36 when the endwalls of the two segments are placed adjacent to each other as shown in FIG. 7. Upon relative upward movement of the segment on the left in FIG. 7, the free arms 42, 52 of the latches 36, 38 will flex until the opposed shoulders 46, 54 move past each other as shown in FIG. 9. The latches are quite small and project beyond the surfaces 22', 24' by only a slight distance. As a result, the spacing between the adjacent cells of two segments 13 is the same as the spacing between adjacent cells in any one of the segments. In other words, the spacing between adjacent cells remains constant even if a connector is made up of two or more individual segments 13. The latches can also be cut by passing a cutting blade between the two adjacent cells in the two adjacent segments.

Each of the terminals comprises a pair of parallel plate members 60 having the upper ends as viewed in FIG. 2 connected by straps 62. The plates have wire receiving slots 64 and each plate has an integral transition section 66 from which extend contact arms 68 that are designed to receive a tab type terminal.

The individual cover members 72 for the housing are also produced in the form of segments 70, each segment having an ear 80 at one end and a recess 82 at the other end so that segments can be bonded or welded to each other to produce a continuous cover member for a connector. The undersides of the cover members as viewed in FIG. 2 have integral inserters, see FIG. 12, as shown at 74 which insert the wires into the wire receiving slots 64 of the terminals when the cover members are assembled to the housing. The cover members also have latch arms 76 having upwardly facing shoulders 78 so that the cover can be latched to the housing with the shoulders 78 against the downwardly facing shoulders 32 of the web portions of the housing.

Adjacent cover members 72 in each segment are connected by a connecting web 84 having a kerf therein. The web 84 does not overlap the associated cell webs 34 so that after assembly of a cover to a connector, adjacent cells can be separated by passing a cutting blade through the aligned kerfs in the cover and in the cell webs 30.

A single segment 13 may serve as a feed through type connector 8. Alternatively, two or more segments may be assembled to each other to produce a larger feed through connector 8.

Figure 10:
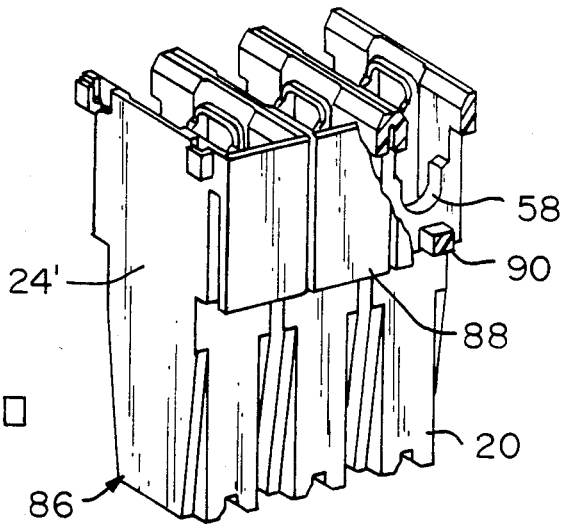
FIG. 10 is a perspective view of a segment of an alternative type of housing.

FIG. 10 shows a segment 86 for a wire end connector 6. This segment also comprises individual cells and is in most respects similar to the segments 13. The segment 86, however, has a sidewall shield 88 on one of its sidewalls that extends from the end 16 past the wire admitting slots 58 of the sidewalls of the cells in the segments 13. These shields 88 are connected to the ends of the webs and are integral with connecting segments 90 on the cell sidewalls. These shields cover the cut ends of the wires in a wire end connector 6.

It will be apparent that a composite connector 10 can be produced by latching a segment 86 to a segment 13 and cutting off the unwanted cells 14, 14' of either type, feed through or wire end.

Figure 12:
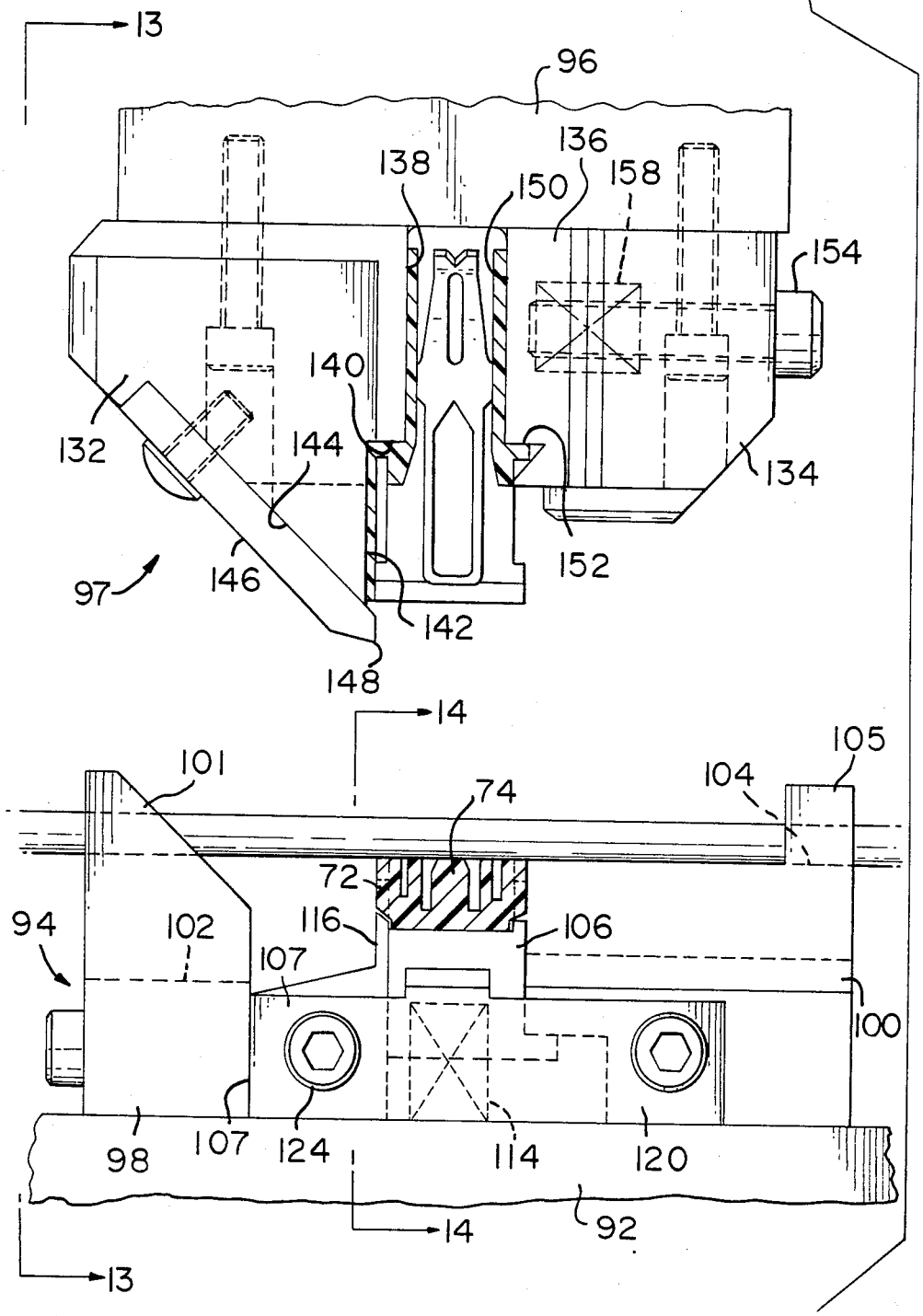
FIG. 12 is a side view showing an inserting apparatus in accordance with the invention mounted on a press, this view showing the positions of the parts prior to cutting of the wires during assembly of the cover member to the connector housing.

Referring now to FIGS. 11–14, an apparatus in accordance with the invention is mounted on a press having a platen or lower support 92 and a ram 96 which is movable towards and away from the support 92. Lower tooling 94 is mounted on the support and upper tooling 97 is mounted on the lower end of the ram 96. The lower tooling comprises a pair of spaced-apart wire jig blocks 98, 100 which collectively form a wire jig for holding wires 4 in side-by-side parallel relationship with the spacing between adjacent wires being the same as the spacing between the terminals 28 in a connector. The block 98 has recesses 102 on its upper end for the wires and the block 100 has recesses 104. The right-hand side 101 of block 98, as viewed in FIG. 12, is downwardly inclined for reasons discussed below. Block 100 has upstanding ears 105 on its left-hand end and the recesses extend across the block to the surface 110 thereof so that the wires can be moved downwardly into these recesses from the positions they occupy in FIG. 12.

The lower tooling further comprises a cover jig for holding a cover as shown in FIG. 12 in opposed relationship to a housing in the upper tooling 97. The cover jig comprises a floating cover jig block 106, a fixed retainer block 107, and the leftwardly facing surface 110, as viewed in FIG. 12, of the block 100. These three blocks thus form a nest within which the cover member can be precisely positioned with the cover on the upper surface 108 of the block 106. Block 106 has recesses 112 on its underside and coil springs 114 are provided in these recesses so that the block is normally in an elevated position as shown in FIG. 12. It is held against an overlapping shelf 113 in the block 100 but can move downwardly from the position shown in FIG. 12 with accompanying compression of the springs 114. A stop plate 118 is secured to the left-hand ends of the blocks 100 and 107 and the end of the cover member is located against this stop plate.

When a wire end type connector 6 as shown in FIG. 10 is being installed on wires 4, it is necessary to cut the wires during installation. A plurality of cutters 116 are provided on the block 107 which cooperate with cutters 146 in the upper tooling as will be described below.

As will also be described below, when the cover members are fed to the lower tooling as continuous strip tool material, it is necessary to cut the strip material at the end of the cover jig 100. This cutting is accomplished by a cover strip cutter 120 having a cutting edge 122 which is adjacent to the end of the cover jig. The edge 122 will be in alignment with the cover web 84 of the strip material and upon downward movement of the strip, the edge 122 will cut through the web. Cutter 120 is secured to blocks 100, 107 by screws 124.

Under some circumstances, it will be desirable to cut a connector 6, 8, or 10 in the apparatus intermediate its ends to form two smaller multi-contact connectors. To accomplish this type of cutting, a segment cutter 126 is provided which has a blade portion that extends through a slot 130 in the block 106, see FIG. 14. The edge 128 of the blade is normally below the surface 108 but when the block 106 is moved relatively downwardly from the position of FIG. 14, the edge 128 will cut through the kerf of the cover member supported on surface 108 and will also cut through the webs 30 of the associated cells of the connector held in the upper tooling.

The upper tooling 97 comprises a pair of spaced-apart housing jig blocks 132, 134 and a floating plate 136 which is between the opposed surfaces of blocks 132, 134. The block 132 has a vertical surface 138 against which one sidewall of a connector is positioned, and an offset sidewall 142 against which the shield portion of 88 of the connector is located. A downwardly facing shoulder surface 140 is provided which accommodates the offset in the connector housing. The left-hand surface 144 of the block 132 is inclined towards the conductor receiving end of a connector contained in the housing jig and one or more wire cutting blades 146 may be removable secured to this surface by fasteners as shown. These blades have cutting edges 148 that cooperate with the edges of the cutters 116 when the ram 96 is moved downwardly. It should be noted that the edge 148 of each cutter is located rightwardly of the internal surface of the shield portion 88 of the connector housing contained in the housing jig. The width of this blade 148 is such that it can move between the web portions 30 of each cell. It will thus be apparent that upon downward movement of the ram 96 from the position shown in FIG. 12, the wire in alignment with the blade 146 will be cut during assembly of the cover member to the connector housing.

The inclinations of the sides 101, 144 of blocks 98, 132 permits the upper tooling to move downwardly a distance which is sufficient to assemble the cover members to the housing in the upper tooling. Recesses 103 are provided in block 132 for the wires when a feed-through housing is being installed on wires. These recesses are covered by blades 146 when wire end connectors 6 are being installed.

Figure 13:
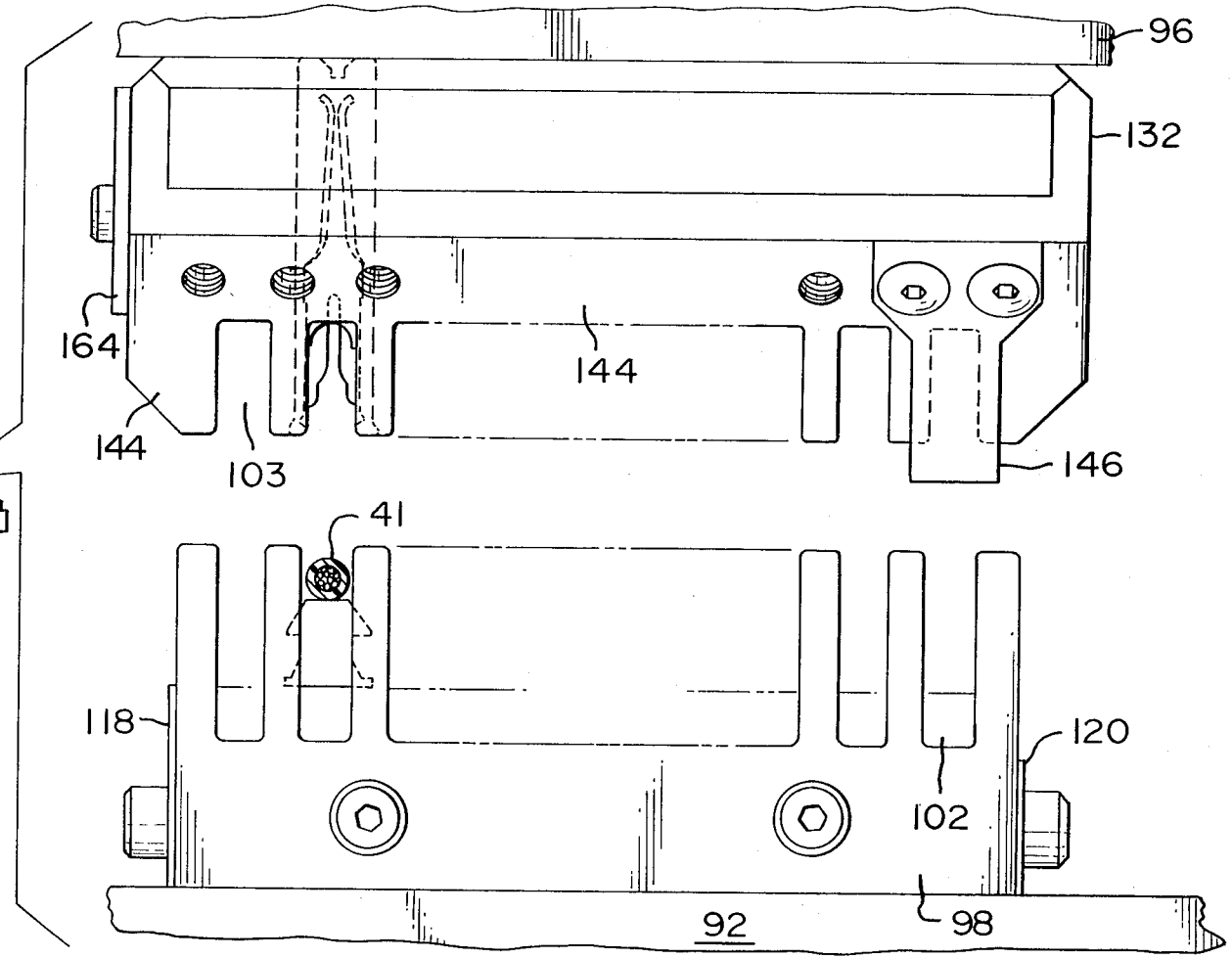
FIG. 13 is a view taken along the lines 13—13 of FIG. 12.

The floating plate 136 has a surface 150 which is opposed to the surface 138 and which is against the sidewall of the connector as shown in FIG. 12. This surface 150 has a generally triangular recess 152 which receives a projecting portion of each cell of the connector housing. The wire receiving face of the connector shown in FIG. 12 is opposed to the cover member in the cover jig. Plate 136 is retained in assembled relationship to plate 134 by screws 154 which extend freely through holes 156 in block 134 and which are threaded into the plate 136. The plate 136 is biased leftwardly as viewed in FIG. 12 by springs 158 that are received in recesses 160, 162 in the block 134 and plate 136 respectively. The right-hand end of the housing jig as viewed in FIG. 13 is open so that a housing can be moved into the housing jig to the position shown in FIG. 12. A suitable stop 164 is provided on the left-hand end of the jig and the end of the housing is moved against this stop during loading of the jig with the housing.

In use, the desired type of housing is positioned in the housing jig and a cover member is positioned in the cover member jig. If the housing is of the wire end type 6, a cutter blade 146 must be provided on the surface 144 for each terminal in the housing. The wires are thereafter placed in the wire jig and the ram 96 is moved downwardly to cause cutting of the wires, insertion of the wire ends into the wire receiving slots of the terminals, and finally latching of the cover member to the housing by means of the latches 76 and shoulders 78, 32. The block 108 moves downwardly during this assembly operation.

If it is desired to install a feed through type connector 8 on the wires 4, the cutters 146 are removed from the block 132. If it is desired to install a composite connector 10, cutters are installed at the appropriate locations on the block 132.

Figure 14:
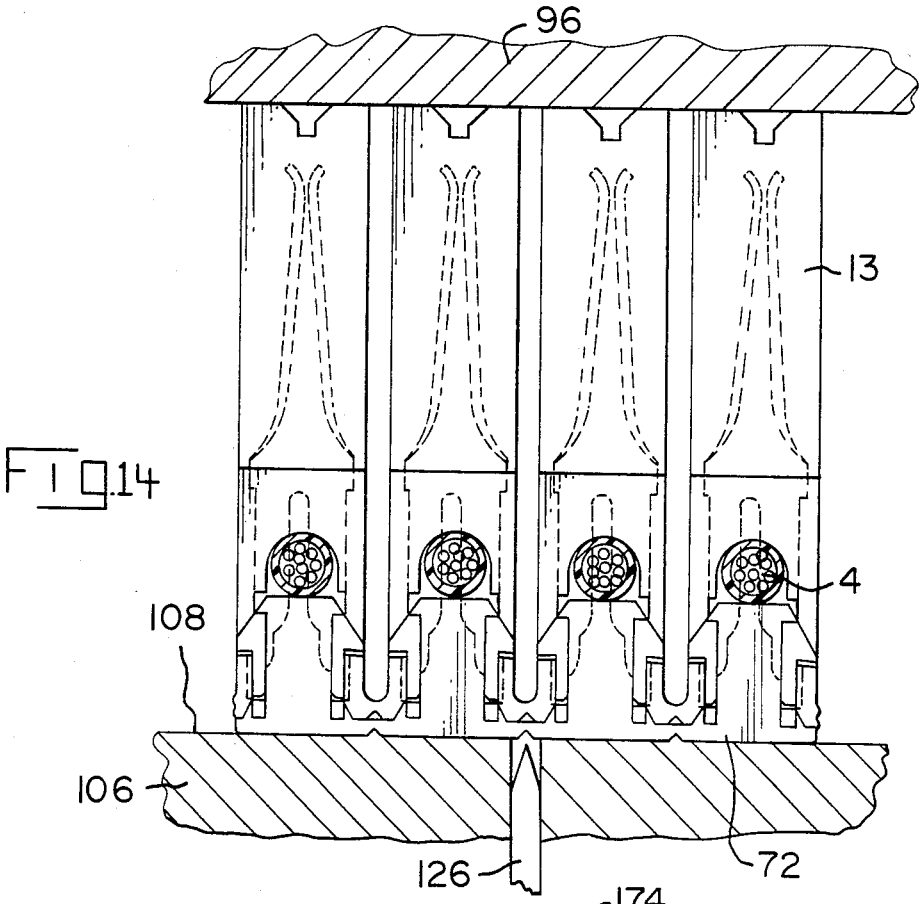
FIG. 14 is a view taken along the lines 14—14 of FIG. 12 but showing the positions of the parts after the connector housing has been moved downwardly and assembled to the cover member.

FIG. 14 illustrates the manner in which a connector in the apparatus may be cut by the housing cutter 126 during the installation process. As the block 106 moves downwardly, the cutting edge 128 penetrates the aligned kerfs of the cutter member and the housing webs and cuts the adjacent cell members apart.

Figure 17:
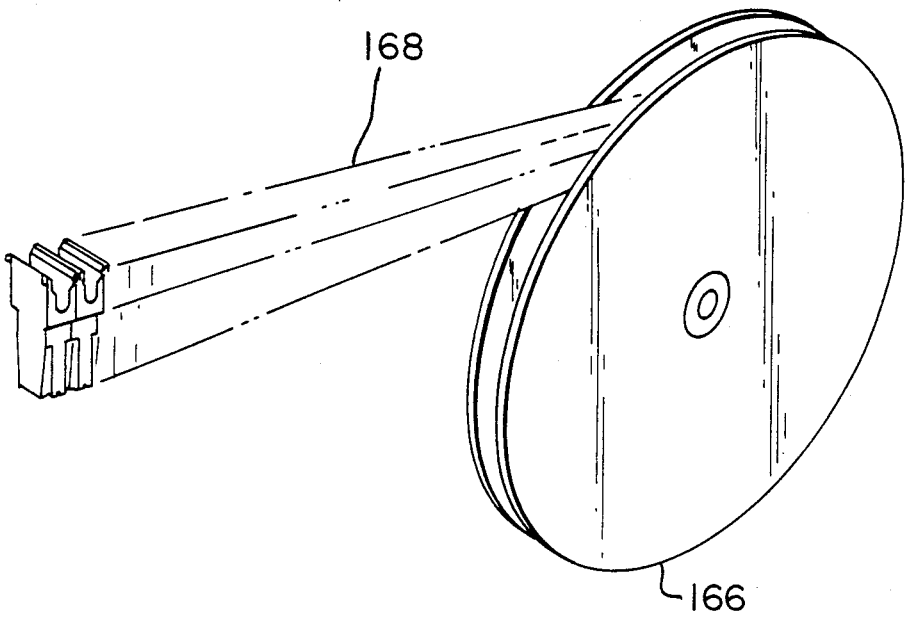
FIG. 17 is a perspective view of a reel of housing strip material.
Figure 18:
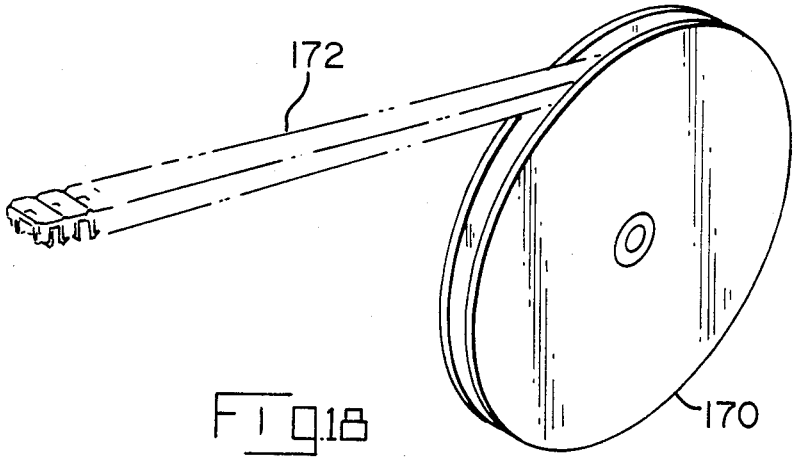
FIG. 18 is a perspective view of a reel of cover strip material.

Housing segments as shown at 86 and at 13 can be latched to each other to form a continuous strip 168 of housing material that can be wound on a reel 166 as shown in FIG. 17. Similarly, the segments of cover members can be bonded or secured to each other to form a strip 172 of cover member material and this material can be wound on a reel 170.

Figure 16:
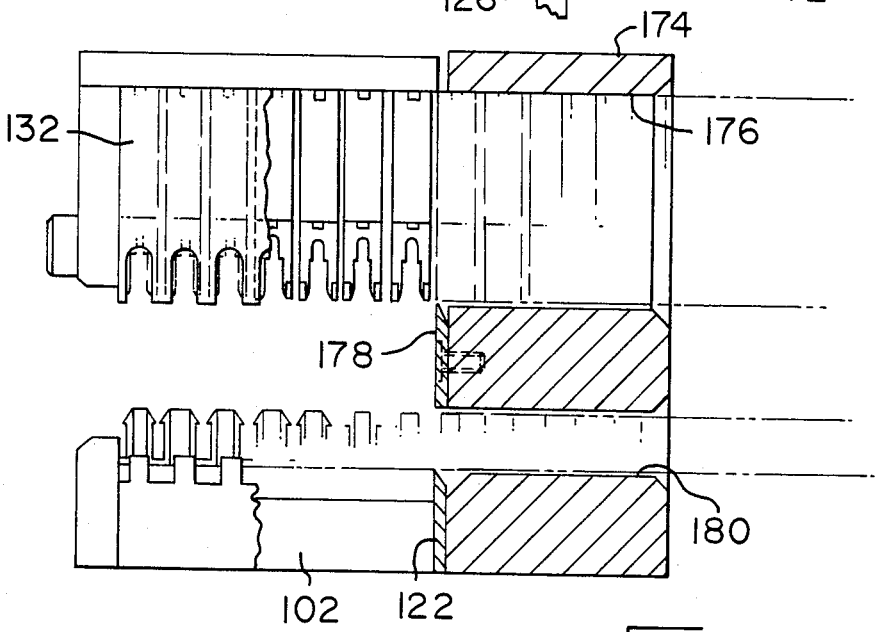
FIG. 16 is an end view of the apparatus having a guide for feeding continuous strip material and continuous strip material to the housing jig and cover jig respectively.
Figure 15:
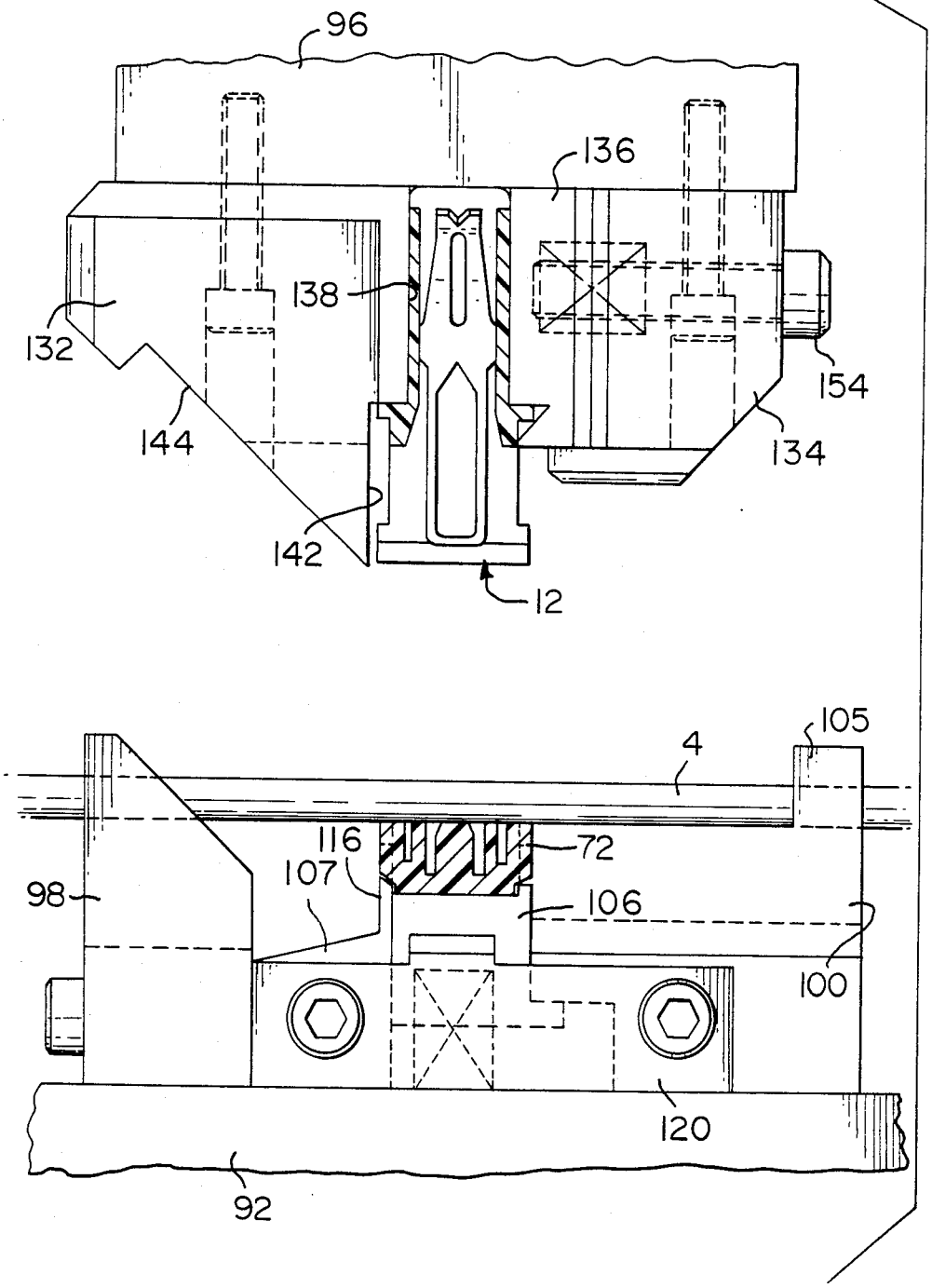
FIG. 15 is a view similar to FIG. 12 showing an alternative type of connector in the connector housing jig.

When housing strip material and cover strip material are used, both types of material can be fed to the apparatus by means of a guide 174 which is mounted in a fixed position relative to the upper and lower tooling as shown in FIG. 16. The guide 174 has passageways 176, 180 for the housing material and cover member material respectively and these passageways guide the strip material into the housing jig and the cover member jig as shown. Feeding may be carried out by any suitable automatic or semi-automatic feeding means or can be done manually by pushing the strip material. When the upper tooling in FIG. 16 moves downwardly, the housing cutter 178 positioned against the surface of the guide cuts off the end portion of the strip 168 thus producing a multi-contact connector having the desired number of terminals therein. This connector is carried to the cover member in the cover jig and the cover member material is severed by the blade 122 as explained previously.

We claim:

1. Apparatus for cutting a cable and installing a connector assembly on the cut end of the cable, the cable comprising a plurality of conductors in side-by-side parallel relationship in a single plane, the connector assembly comprising a connector housing and a cover, the housing having a conductor-receiving face, oppositely facing housing sidewalls and oppositely facing housing endwalls, the sidewalls and endwalls surrounding, and extending from, the conductor-receiving face, the housing having a row of cavities extending inwardly from the conductor-receiving face, the cavities being side-by-side in the row which is between the endwalls, a terminal in each of the cavities, the terminals having conductor-receiving slots at the conductor receiving face, the slots extending normally of the conductor-receiving face and being recessed from the conductor-receiving face so that conductors which extend parallel to the conductor-receiving face can be moved laterally of their axes and into the conductor-receiving slots, one sidewall of the housing having wire-admitting slots therein through which wires inserted into the conductor-receiving slots extend, the cover being dimensioned for assembly to the conductor-receiving face and having inserters thereon for moving conductors into the conductor-receiving slots upon assembly to the housing, the cover having oppositely facing side surfaces and oppositely facing end surfaces which are adjacent to the housing sidewalls and housing endwalls respectively when the cover is assembled to the housing, the apparatus being characterized in that:

the apparatus comprises a cover jig, a housing jig, and a cable locator, the housing jig being opposed to the cover jig, the housing jig and the cover jig having housing holding means and cover holding means respectively for holding a housing with the conductor-receiving face thereof opposed to a cover in the cover jig, the jigs being relatively movable towards each other to assemble the cover to the mating face of the housing, the cable locator being between the cover jig and the housing jig and being effective to locate a cable in a plane between the jigs with the conductors in the cable in alignment with the conductor-receiving slots in terminals in a housing in the housing jig, the housing jig having a first shearing edge thereon which extends parallel to, and is beside one sidewall of a housing in the housing jig, the cover jig having a second shearing edge thereon which extends beside, and is adjacent to, one side surface of a cover in the cover jig, the one side surface being in alignment with the one sidewall of the housing in the housing jig, the first and second shearing edges being discontinuous, each shearing edge comprising a plurality of spaced-apart shearing edge segments which are in alignment with discrete wires in the cable locator whereby, upon placement of a connector housing and cover in the housing jig and cover jig, location of a cable by the cable locator, and upon relative movement of the cover jig towards the housing jig, the cable will be severed by the shearing edges and the conductors will be inserted into the conductor-receiving slots of the terminals.

2. Apparatus as set forth in claim 1 characterized in that the cover jig is in a fixed position, the housing jig being movable towards and away from the cover jig.

3. Apparatus for inserting wires into the wire-slots of terminals which are contained in cavities in an electrical connector housing the housing having a wire-receiving face, oppositely facing sidewalls and oppositely facing endwalls, the sidewalls and endwalls surrounding, and extending from the wire-receiving face, the terminals being in a row which extends between the endwalls, the apparatus being of the type comprising a wire jig, a housing jig, and a plurality of inserters, the wire jig having wire locators for locating the wires in parallel spaced-apart relationship in a single plane with the spacing between the wires equal to the spacing between the terminals in the housing, the housing jig being on one side of the single plane and being positioned to hold a housing with the wire-receiving slots in the terminals in alignment with the wires, the inserters being on the other side of the single plane, each of the inserters being in alignment with one of the wires, the inserters being movable relatively towards the plane so that the inserters push the wires towards a housing in the housing jig and into the wire-receiving slots of the terminals, the apparatus being characterized in that:

the inserters are integral with a connector closure which is dimensioned to be assembled to the housing during insertion of the wires into the wire-receiving slots, the closure having one major surface from which the inserters extend and having oppositely facing side surfaces and oppositely facing end surfaces which surround, and extend from, the one major surface, a connector closure jig is provided on the other side of the single plane, the closure jig being movable relatively towards and away from the housing jig, the housing jig has a first shearing edge thereon and the closure jig has a second shearing edge thereon, the first shearing edge extending parallel to, and being beside, one sidewall of a housing in the housing jig, the second shearing edge being opposed to, and cooperable with the first shearing edge, a housing severing blade being provided in the closure jig, the housing severing blade having a housing severing edge which extends normally of the second shearing edge and is located between two adjacent wires in the wire jig whereby during assembly of the housing to the closure, the wires are severed by the first and second shearing edges and the housing and the closure are severed between two adjacent cavities by the housing severing blade.

4. Apparatus as set forth in claim 3 characterized in that the wire jig comprises a pair of spaced-apart wire combs.

5. Apparatus as set forth in claim 3 characterized in that the first severing edge and the second severing edge each have a plurality of spaced-apart notches therein which are in opposed aligned relationship, the apparatus being intended for use with a housing having wire admitting slots in the one sidewall at the wire-receiving face which are in alignment with the terminals in the cavities, the housing and closure having ledges on the one sidewall and on the one side surface of the housing and closure respectively, the ledges being between juxtaposed cavities in the housing, the notches being dimensioned to receive the ledges.

6. Apparatus for serially installing multi-contact connectors on conductors which are in side-by-side parallel co-planar relationship, the connectors each comprising an insulating housing having a conductor-receiving face, oppositely facing housing sidewalls and oppositely facing housing endwalls, the endwalls and sidewalls surrounding, and extending from, the conductor-receiving face, a plurality of side-by-side terminal-receiving cavities extending into the housing from the conductor-receiving face, the cavities being in a row which extends between the housing endwalls, terminals in the cavities, the terminals having wire-receiving slots which receive the conductors upon movement of the conductors laterally of their axes and into the conductor-receiving slots, the apparatus being of the type comprising a connector housing jig for holding a housing, a conductor locator for positioning the conductors adjacent to the housing jig with the axes of the conductors extending normally of the sidewalls of a housing in the housing jig with each conductor in alignment with the wire-receiving slot of one of the terminals, and the apparatus further comprising an inserter, the inserter being opposed to, and movable relatively towards, the housing jig and having insertion punches for pushing the conductors in the conductor jig into the terminals in a housing in the housing jig, the apparatus being characterized in that:

the housing jig comprises spaced-apart housing jig sidewalls having opposed housing locating surfaces between which the housing is located, the housing jig having first and second ends between which the housing jig sidewalls extend, a housing endwall stop on the housing jig at the first end thereof, the second end of the housing jig being open, a housing strip material guide adjacent to the second end of the housing jig for guiding endless housing strip material from a source thereof into the housing jig thereby to position the leading portion of the housing strip material in the housing jig, and a material cutter between the housing jig and the housing strip material guide for cutting the strip of housing material at the second end of the housing jig whereby, upon placement of conductors in the conductor jig, feeding of the housing strip material into the housing jig and relative movement of the housing jig towards the inserter with accompanying relative movement of the housing strip past the material cutter, a connector will be cut from the leading portion of the housing strip material and installed on the conductors.

7. Apparatus as set forth in claim 6 characterized in that the apparatus is intended for use with connectors which comprise housing covers that are assembled to the conductor receiving face of the connector housing so that the conductors are covered by the housing covers, the housing covers having the insertion punches thereon, the apparatus having a cover jig for supporting a cover in opposed relationship to a housing in the housing jig, a cover strip material guide is provided beside the cover jig for guiding endless cover strip to the cover jig thereby to position the leading portion of the cover strip material in the cover jig and a cover strip cutter is provided adjacent to the cover jig, the cover strip cutter being movable relative to cover strip material in the cover jig thereby to cut a section of cutter strip for assembly to a connector housing in the housing jig.

8. Apparatus as set forth in claim 7 characterized in that a connector cutter is provided for cutting a connector and a cover strip during installation thereof on wires, the connector cutter being contained in the cover jig and having a cutting edge which extends normally of the sidewalls of a connector housing in the housing jig.

* * * * *